United States Patent [19]

Sato

[11] Patent Number: 4,843,939

[45] Date of Patent: Jul. 4, 1989

[54] APPARATUS FOR ADJUSTING HEIGHT OF PIANO PEDAL

[75] Inventor: Masaru Sato, Iwata, Japan

[73] Assignee: Toyo Piano Mfg. Co., Ltd., Hamamatsu, Japan

[21] Appl. No.: 274,467

[22] Filed: Nov. 21, 1988

[30] Foreign Application Priority Data

Dec. 31, 1987 [JP] Japan ..... 62-200234

[51] Int. Cl.[4] ..... G10C 3/26

[52] U.S. Cl. ..... 84/230; 84/358; 74/562

[58] Field of Search ..... 84/72–78, 84/225–232, 312 P, 353, 357–358, 366, 426, 444, DIG. 25; 74/560, 561, 562

[56] References Cited

U.S. PATENT DOCUMENTS

| | | | |
|---|---|---|---|
| 197,370 | 11/1877 | Holder | 84/231 |
| 296,308 | 4/1884 | Bettman | 84/232 |
| 693,477 | 2/1902 | Wittman | 84/230 |
| 1,379,570 | 5/1921 | Jefferson | 84/230 |

*Primary Examiner*—L. T. Hix
*Assistant Examiner*—Brian W. Brown
*Attorney, Agent, or Firm*—Darby & Darby

[57] ABSTRACT

An apparatus for adjusting the height of a piano pedal includes an assembly member provided at the proximal end of a pedal, a support member provided at the distal end of a pedal frame, the support member and the assembly member being movable in the vertical direction relative to each other, and an operation bolt in thread engagement with a screw hole formed in the support member in the vertical direction, a head portion of the operation bolt being pivotally supported at the lower portion of the assembly member.

5 Claims, 6 Drawing Sheets

APPARATUS FOR ADJUSTING HEIGHT OF PIANO PEDAL

BACKGROUND OF THE INVENTION

1. Field of the Invention

The present invention relates to an apparatus for adjusting the height of a piano pedal.

2. Description of the Related Art

Piano pedals are provided on the lower portion of a piano body A at a front frame 17, as shown in FIG. 1, and are used by a piano player to change tone quality. Conventionally, a horizontal portion 1*a* of a pedal fringe 1 having an L-shaped form is fixed to the upper surface of a bottom plate 18 of the body A by means of a bolt 19, and the proximal end of a pedal frame is pivotally fixed through a support shaft 20 to the upper end of a vertical portion 1*b* of the pedal fringe 1. A horizontal rod 22 which swings under the force of a spring 21 is connected to the intermediate portion of the pedal frame 2 through a hanging rod 23. The distal end of the pedal frame 2 is led through a hole 24 which is formed in the lower portion of the front frame 17 of the piano body A and which is padded with a pedal cushioning cloth 3. A pedal 4 is fixedly mounted on the distal end of the pedal frame 2.

In the above-described arrangement, since the vertical position of the pedal 4 is fixed, it may be too high or too low for individual players.

The pedal position is therefore fitted for individual players by moving the player's stool toward or away from the piano or by adjusting the height of the stool.

SUMMARY OF THE INVENTION

An object of the present invention is to provide an apparatus for adjusting the height of a piano pedal which is capable of adjusting the height of a pedal to allow individual piano players to assume a good posture.

DETAILED DESCRIPTION OF THE PREFERRED EMBODIMENTS

The present invention will be described below by referring to an example with reference to the accompanying drawings.

Figure 1:
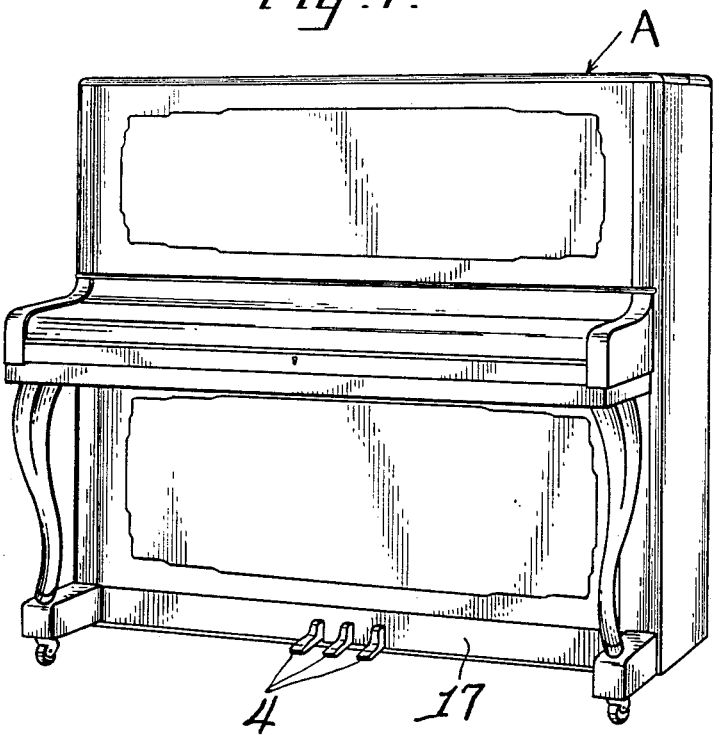
FIG. 1 is a pespective view of a piano.
Figure 2:
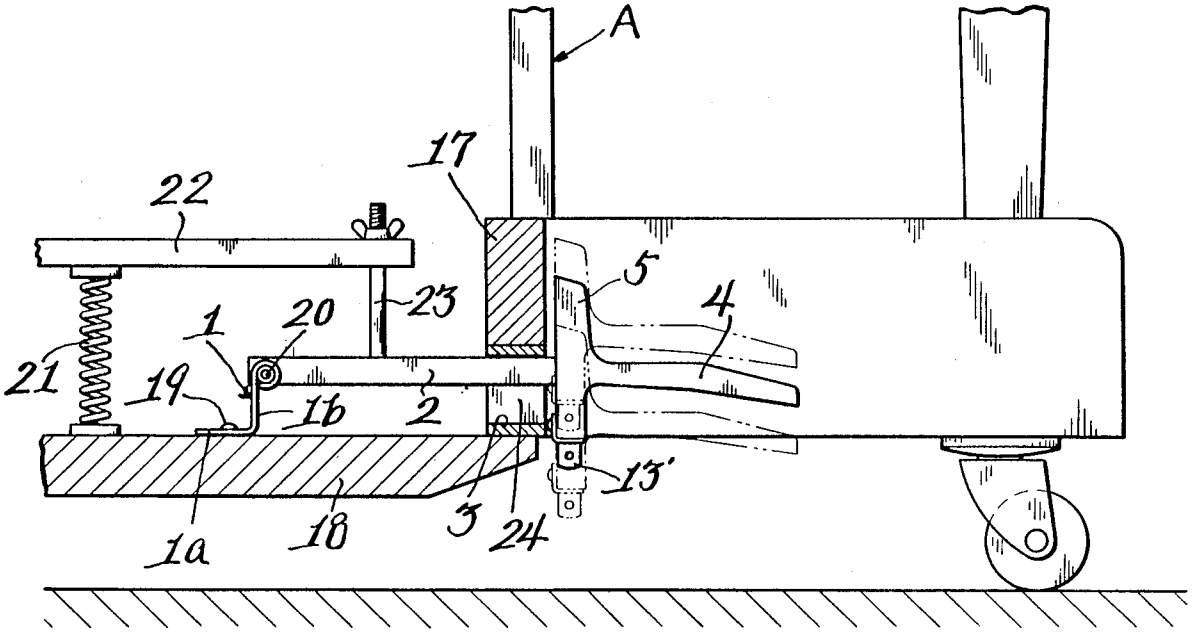
FIG. 2 is a side elevational view of that portion of a piano body where a pedal is mounted with parts broken away, showing the relationship between the piano body and the pedal.
Figure 3:
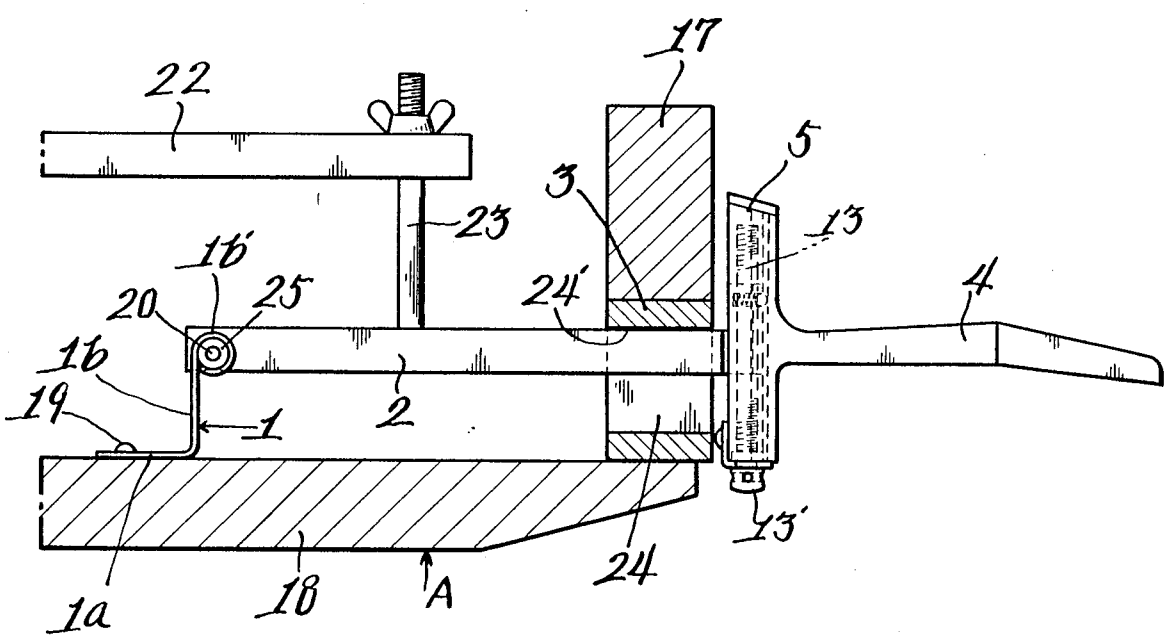
FIG. 3 is an enlarged side elevational view of the same portion with parts broken away.
Figure 4:
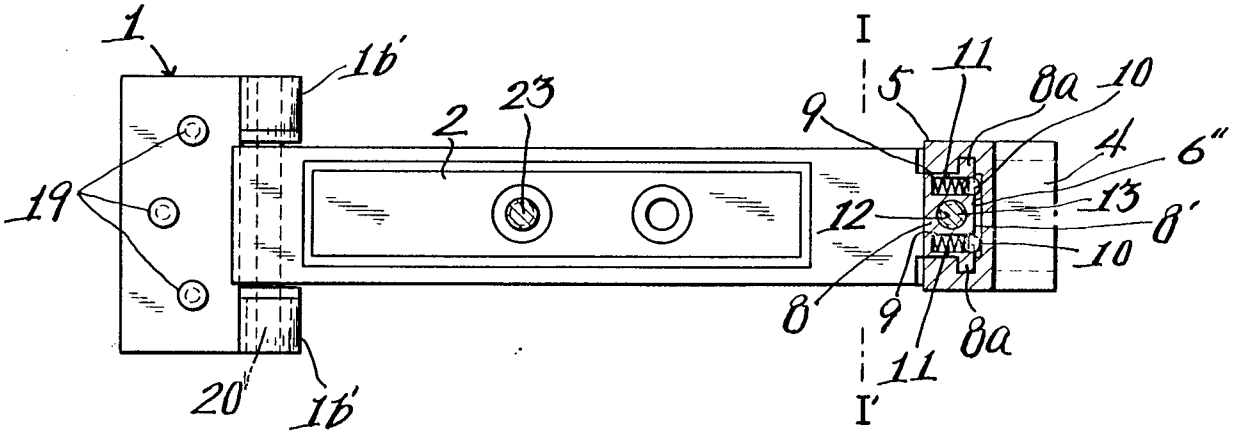
FIG. 4 is a horizontal cross-sectional view, showing the relationship between a pedal frame and a pedal.
Figure 5:
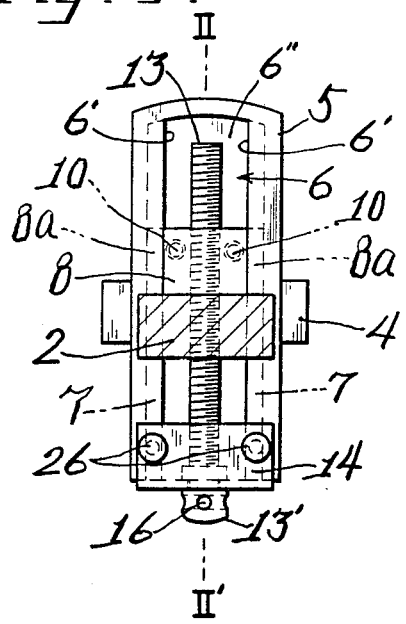
FIG. 5 is a section taken along the line I—I' of FIG. 4.
Figure 6:
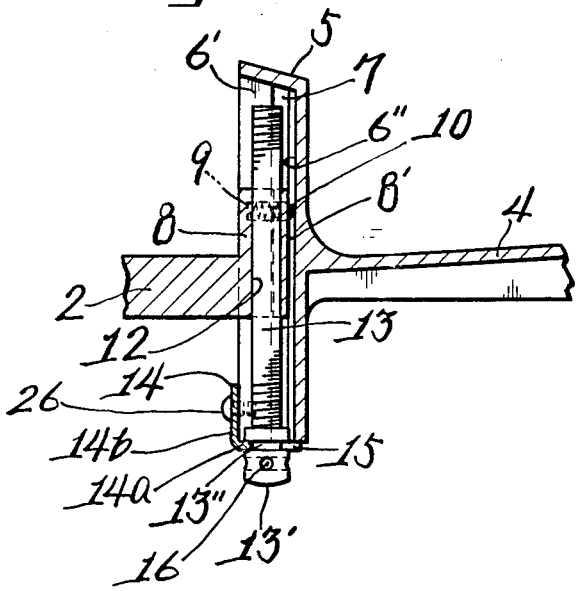
FIG. 6 is a section taken along the line II—II' of FIG. 5.
Figure 7:
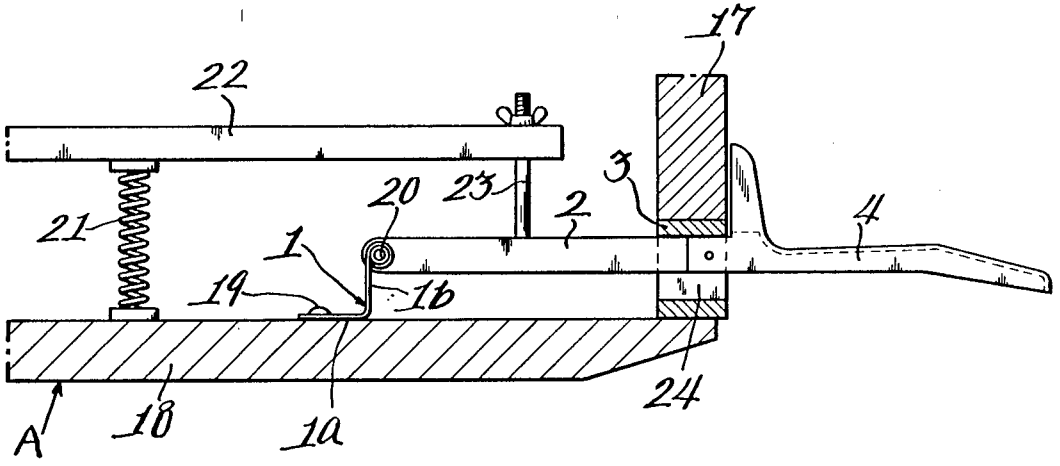
FIG. 7 is a side elevational view of the pedal of a conventional piano body with parts broken away, showing the relationship between the piano body and the pedal.

Like the conventional one described above with reference to FIG. 7, the horizontal portion 1*a* of the L-shaped pedal fringe 1 is fixed by means of the bolt 19 to the upper surface of the bottom plate 18 of the body A.

The proximal end of the pedal frame 2 is pivotally fixed to the pedal fringe 1 through the support shaft 20 which extends between and engages with receiving members 25 supported by bending portions 1*b*' and 1*b*' provided at the upper end of the vertical portion 1*b* of the pedal fringe 1. The horizontal rod 22 which swings under the force of the spring 21 is connected to the intermediate portion of the pedal frame 2 through the hanging rod 23. The distal end of the pedal frame 2 is led through the hole 24 which is formed in the lower portion of the front frame 17 and which is padded by the pedal cushioning cloth 3. The pedal 4 is mounted on the distal end of the pedal frame 2.

A reference numeral 5 designates an assembly member which is provided at the proximal end of the pedal 4. The assembly member 5 is elongated in the vertical direction. The assembly member 5 has a concave portion 6 at the back thereof which is defined by opposing side walls 6' and a rear wall 6''. A guide groove 7 runs in the vertical direction at a portion of each of the side walls 5' which is close to the rear wall 6''. A supporting member 8 is provided at the distal end of the pedal frame 2, and pieces 8*a* of the supporting member 8 engage with the guide grooves 7, by which the pedal frame 2 is coupled to the pedal 4 in such a manner as to be movable in the vertical direction relative to the pedal 4.

A distal end surface 8' of the support member 8 of the pedal frame 2 which is fitted in the concave portion 6 of the assembly member 5 has a hole 9 which accommodates a ball 10. The ball 10 is pressed against the rear wall 6'' of the concave portion 6 by a spring 11 provided in the support hole 9 and this prevents any backlash occurring between the pedal frame 2 and the pedal 4 due to the engagement of the pieces 8*a* of the support member with the guide grooves 7.

A screw hole 12 is formed in the support member 8 in the vertical direction, and an operation screw 13 is screwed into the screw hole 12. The operation screw 13 has a small diameter portion 13'' at its head portion 13'. The small diameter portion 13'' is fitted in a notch 15 formed in a horizontal portion 14*a* of a support piece 14, by means of which the support piece 14 is able to support the small diameter portion 13''. The support piece 14 is an L-shaped member which consists of the horizontal portion 14*a* and a vertical portion 14*b*. The support piece 14 is fixed to the lower end of the assembly member 5 by a screw 26 which passes through the vertical portion 14*b* into the assembly member 5.

The head portion 13' of the operation screw 13 has a through-hole 16 which is used when the operation screw 13 is turned.

So long as no external force is imposed on the pedal frame 2, the pedal frame 2 is pressed against an upper edge 24' of the hole 24 under the force of the spring 21, and the support member 8 provided at the distal end of the pedal frame 2 is located at a fixed position. If in this state the operation screw is pivoted by a rod inserted into the through-hole 16 provided in the head portion 13' of the operation screw, since the support member 8 of the pedal frame 2 into which the operation screw 13 is screwed is located at a fixed position under the force of the spring 21, the operation screw 13 moves in the vertical direction through the screw hole 12 in the support member 8. At the same time, since the operation screw 13 and the assembly member 5 of the pedal 4 act as one unit by virtue of the support member 14 being fixed to the assembly member 5 by a screw, vertical movement of the operation screw 13 through the screw hole 12 moves the assembly member 5, i.e., the pedal 4, in the vertical direction through the support piece 14. Pivoting of the operation screw 13 is stopped when the pedal 4 is located at a suitable height, thereby completing a pedal height adjusting operation.

In the present invention, the pedal is moved vertically by the pivoting of the operation bolt so as to allow the vertical position of the pedal to be adjusted.

In consequence, a suitable position of the pedal which fits an individual player's posture can be set.

What is claimed is:

1. An apparatus for adjusting the height of a piano pedal, comprising: an assembly member provided at the proximal end of a pedal; a support member provided at the distal end of a pedal frame, said support member and said assembly member being movable in the vertical direction relative to each other; and an operation bolt in thread engagement with a screw hole formed in said support member in the vertical direction, the head portion of said operation bolt being pivotally supported at the lower portion of said assembly member.

2. An apparatus for adjusting the height of a piano pedal according to claim 1, wherein said assembly member has a concave portion having side walls, each of said opposing side walls of said concave portion having a guide groove which runs in the vertical direction, each part of said support member which is engaged with said concave portion engaging with said guide groove.

3. An apparatus for adjusting the height of a piano pedal according to claim 1 wherein a support piece is mounted on the lower portion of said assembly member, said support piece having a notch with which a small diameter portion provided at said head portion of said operation bolt engages.

4. An apparatus for adjusting the height of a piano pedal according to claim 1 wherein said head portion of said bolt has a through-hole into which a desired rod is inserted.

5. An apparatus for adjusting the height of a piano pedal according to claim 1 wherein said pedal frame is pressed against the upper edge of a hole provided in a piano body under the force of a spring.

* * * * *